US005994044A

United States Patent [19]

Hagemann et al.

[11] Patent Number: 5,994,044

[45] Date of Patent: Nov. 30, 1999

[54] COLOR PHOTOGRAPHIC RECORDING MATERIAL

[75] Inventors: Jörg Hagemann; Werner Hoheisel, both of Köln; Reimer Holm, Bergisch Gladbach, all of Germany

[73] Assignee: Agfa-Gevaert AG, Leverkusen, Germany

[21] Appl. No.: 09/173,308

[22] Filed: Oct. 15, 1998

[30] Foreign Application Priority Data

Oct. 22, 1997 [DE] Germany ..... 197 46 513

[51] Int. Cl.[6] ..... G03C 1/815

[52] U.S. Cl. ..... 430/512; 430/507; 430/510; 430/523; 430/961

[58] Field of Search ..... 430/512, 523, 430/507, 961, 510

[56] References Cited

U.S. PATENT DOCUMENTS

| | | | |
|---|---|---|---|
| 5,472,477 | 12/1995 | König | 75/343 |
| 5,731,136 | 3/1998 | Schmuck | 430/512 |

FOREIGN PATENT DOCUMENTS

| | | |
|---|---|---|
| 736 800 | of 0000 | European Pat. Off. . |
| 92/21315 | 12/1992 | WIPO . |
| 93/06164 | 4/1993 | WIPO . |
| 95/09895 | 4/1995 | WIPO . |

*Primary Examiner*—Richard L. Schilling
*Attorney, Agent, or Firm*—Connolly Boev Lodge & Hutz LLP

[57] ABSTRACT

A color photographic recording material which contains particles of elemental silicon and/or of solid compounds in which silicon is present in stoichiometric excess, having an average diameter of ≦120 nm, is distinguished by improved protection against UV radiation.

13 Claims, No Drawings

COLOR PHOTOGRAPHIC RECORDING MATERIAL

This invention relates to a colour photographic recording material which contains a novel, substantially improved UV light absorber.

It is known that UV radiation, even at the intensity at which it reaches the earth's surface in sunlight, has a harmful effect on many substances. Colour photographic materials accordingly always contain UV absorbers in order to improve or ensure the stability of the image dyes present in the material after processing. High-UV daylight may cause fading of image dyes.

The UV absorbers hitherto used have usually been organic compounds which exhibit a molecular absorption band within the relevant range of wavelengths and do not absorb within the visible range of the spectrum.

The compounds conventionally used in photographic materials for absorbing UV light are. for example, aryl-substituted benzotriazole compounds (U.S. Pat. No. 3,533,794, DE-A-42 29 233), 4-thiazolidone compounds (U.S. Pat. Nos. 3,314,794, 3,352,681). benzophenone compounds (JP-A-2784/71), cinnamic acid esters (U.S. Pat. Nos. 3,705,805, 3,707,375), butadiene compounds (U.S. Pat. No. 4,045,229), benzoxazole compounds (U.S. Pat. No. 3,700,455), aryl-substituted triazine compounds (DE-A-21 13 833, EP-A-520 938, EP-A-530 135, EP-A-531 258) and benzoylthiophene compounds (GB-A-973 919, EP-A-521 823). UV light absorbing couplers or polymers, which may be immobilised in a specific layer by mordanting, are also used.

One disadvantage of these organic compounds is they themselves have only limited light stability. If the UV light absorbing compounds are destroyed by light, the image dyes begin to fade. Another disadvantage of using organic compounds is the migration thereof to the surface of the photographic material during storage at elevated temperature and/or elevated atmospheric humidity.

This disadvantage may partially be overcome by using $TiO_2$ pigments having an average primary particle diameter of 10 to 100 nm, preferably of 15 to 30 nm. These $TiO_2$ pigments are transparent and, in comparison with conventional white pigments based on $TiO_2$ (rutile and anatase) having a particle size of approx. 0.2 mm, have virtually no light-scattering characteristics.

EP-A-736 800 discloses such compounds and the use thereof as UV absorbers in photographic materials.

However, UV light absorbers containing particles made from the above-stated inorganic compounds have the disadvantage that, due to an absorption edge which extends over broad portions of the UVA range (320 to 400 nm) and/or a relatively small cross-section of absolute absorption action, elevated particle concentrations are necessary in order to ensure adequate light absorption over the entire UVA range. However, the consequently necessary elevated particle concentrations result in greater haze and entail a risk of poor mechanical strength of the photographic material. Moreover, $TiO_2$, the hitherto best known UV light absorbing particle, is photocatalytically active, such that the particles must be coated in order to prevent the medium to be protected from being damaged by free radical formation initiated by the particles themselves.

The object of the present invention was accordingly to provide UV light absorbers which do not exhibit the known disadvantages of the prior art and which are particularly suitable for long term protection of photographic materials.

It has now been found that this object may be achieved by the use of solid particles of silicon and/or of compounds in which silicon is present in stoichiometric excess having an average diameter of ≦120 nm as a UV absorber in photographic materials.

The present invention accordingly provides a colour photographic recording material having at least one photosensitive silver halide emulsion layer and optionally a non-photosensitive layer, which is arranged closer to the light source than the photosensitive silver halide emulsion layer, characterised in that at least one of the stated layers contains particles of elemental silicon and/or of solid compounds, in which silicon is present in stoichiometric excess, having an average diameter of ≦120 nm.

Average diameter should be taken to mean the maximum of the frequency distribution.

The elemental silicon is amorphous or crystalline silicon, preferably crystalline silicon. The size of the silicon particles is preferably between 1 nm and 120 nm, particularly preferably between 1 nm and 70 nm and very particularly preferably between 10 nm and 50 nm. These particles preferably have a size distribution with a maximum half-width of 40 nm. Silicon particles having this average diameter are preferably produced by means of a gas phase reaction (CVR) in accordance with the process described in U.S. Pat. No. 5,472,477. Production may also be performed in accordance with *J. Phys. Chem.,* 97, pages 1224 to 1230 (1973), *J. Vac. Sci. Technol.* A10, page 1048 (1992) and *Int. J. Heat Mass Transfer,* 31, page 2236 (1988).

Solid compounds include compounds which are solid at room temperature, such as for example silicides. Examples of suitable silicides are $CaSi_2$ and $BaSi_2$. Compounds in which silicon is present in stoichiometric excess preferably include compounds of the formula $Si_xZ_{1-x}$, where x>0.5 and Z=C, N, O, Ge, Ca, Ba and/or Sr. x is particularly preferably >0.7. In a preferred embodiment, Z means C or Ge.

In a preferred embodiment of the invention, the solid compounds in which silicon is present in stoichiometric excess have a core/shell structure. The average diameter of the particles is preferably less than 120 nm, particularly preferably less than 100 nm, very particularly preferably less than 50 nm. They preferably have a particle size distribution with a maximum half-width of 40 nm. It is preferred in this connection that these particles consist of a core of titanium nitride and a shell of silicon, wherein the proportion of silicon by volume in each particle is at least 30%.

In another preferred embodiment of the invention, the UV light absorber contains shell particles in the form of a solid compound which consists of silicon and those materials which are more highly absorbent in the red range of the spectrum (600 nm<λ<700 nm) than in the cyan range of the spectrum (400 nm<λ<550 nm).

The solid compounds, including those having a core/shell structure, may be produced, for example, by thermal decomposition of a gas containing silicon, such as for example silanes, organosilanes or $SiCl_4$, such that an aerosol is obtained (c.f. *J. Phys. Chem.* 97 pages 1224 to 1230 (1973), *J. Vac. Sci. Technol.* A10, page 1048 (1992)). Admixing further gases, which contain, for example, germanium or carbon, results in the formation of compounds of a corresponding stoichiometric composition. In the case of solid compounds having a core/shell structure, the core is first made by means of the process described above and the shell then applied by means of gas phase decomposition or reaction of gases of an appropriate composition, such as for example $SiH_4$ or $SiCl_4$ together with $H_2$. Thermal decomposition may be proceed in a gas phase reactor, preferably in a CVR (chemical vapour reaction) reactor, or also by laser absorption (c.f. *Int. J. Heat Mass Transfer* 31, page 2239

(1988)). Thermal decomposition of gases is particularly suitable for the production of crystalline particles. Production may also proceed by means of a PECVD (Plasma Enhanced Chemical Vapour Deposition) process (c.f. *J. Vac. Sci. Technol.* A10, page 1048 (1992)). The latter process produces amorphous particles, which may be crystallised by means of thermal post-treatment (c.f. *Nanostructured Materials* volume 6, pages 493 to 496 (1995)).

In a preferred embodiment, the particles are spherical. The particles present in the UV light absorber may also take the form of agglomerates. In the case of silicon, the optical properties of the agglomerates differ from those of the primary particles, as the electro-magnetic interaction of the particles results in the formation of new absorption channels, some of which are also within the visible range of the spectrum.

The primary particles present in the UV light absorber may also be enclosed in an oxide layer. This prevents the primary particles from coming into direct contact and thus agglomerating. The thickness of the oxide layer is preferably 1 nm to 300 nm, particularly preferably 10 nm to 100 nm. This oxide layer may be applied, for example, by apportioning oxygen into the CVR reactor once the particles have been produced.

In a preferred embodiment, the UV light absorber according to the invention additionally contains particles of metal oxides and/or nitrides which are more highly absorbent in the red range of the spectrum of 600 nm$<\lambda<$700 nm than in the cyan range of the spectrum of 400 nm$<\lambda<$550 nm. Preferred additives of this type are particles of titanium nitride having an average diameter of 1 nm to 400 nm, preferably of 10 nm to 120 nm or agglomerates of these titanium nitride primary particles. Production thereof may proceed, for example, in accordance with U.S. Pat. No. 5,472,477. In a preferred embodiment, the UV light absorber also contains, as well as silicon particles, TiN particles having an average diameter of 10 to 120 nm. This UV light absorber is highly effective in the UVA range and simultaneously combines colour neutrality and elevated transparency. Other preferred additives are particles of aluminium/sodium silicates (ultramarine pigments), obtainable, for example, as Nubix® Pigments from the company Nubiola S.A.. The UV light absorber may furthermore contain iron (III) hexacyanoferrate(II) as an additive.

In a further embodiment of the invention, the UV light absorber preferably consists of a mixture of the particles containing silicon and particles of the following group: silicon carbide and/or oxides of the metals titanium, cerium, tungsten, zinc, tin and iron. The absorption edge, in particular the steepness thereof, may be manipulated by such mixtures. The particle size of the added particles is preferably between 1 nm and 200 nm. These particles may also be obtained, inter alia, in accordance with the process described in U.S. Pat. No. 5,472,477.

The silicon compounds according to the invention are located either in the layer in which the dye to be protected from UV light is formed or in a layer which is arranged closer to the light source than the above-stated layer or they are distributed over the various layers.

The silicon compounds according to the invention are preferably used in a layer which is arranged closer to the light source than the layer containing the dye to be protected.

The silicon compounds according to the invention are conventionally used in a quantity of 0.05 to 5 g/m$^2$ of the photographic material.

The photographic material preferably contains the compounds according to the invention in a quantity of 0.1 to 2.5 g/m$^2$.

It is particularly advantageous for the silicon compounds according to the invention to be dispersed in a gelatine solution, such that they may be cast to yield a layer. In this manner, a considerably thinner layer is achieved than with conventional UV absorbers, which must conventionally be dispersed in high-boiling organic solvents and must accordingly be emulsified in a gelatine solution as fine droplets.

The silicon compounds according to the invention impart durable protection against UV light to the dyes of the photographic image obtained after colour development as these compounds, unlike organic UV absorbers, are not destroyed by UV light.

This silicon compounds according to the invention may also be used in photographic materials together with prior art UV absorbers.

Combinations with $TiO_2$, ZnO, $CeO_2$ and SiC are particularly preferred. Corresponding compounds are disclosed in EP-A-736 800, WO 92/21315, WO 93/06164 and WO 95/09895.

Preferred organic UV absorbers which may be combined with the compounds according to the invention are described, for example, in *Research Disclosure* 37038 (1995), part X, 37254 (1995), part 8 and 38957 (1996), part VI and in DE-A-19 537 291, EP-A431 868, EP-A-436 464, EP-A-640 591, EP-A-706 083, EP-A-747 755, EP-A-750 224, U.S. Pat. Nos. 5,362,881 and 5,455,152.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 ( 1995), page 285 and in *Research Disclosure* 38957, part XV (1996), page 627.

The silicon compounds according to the invention are preferably added to colour photographic print materials, i.e. colour photographic paper and transparent colour photographic film for display purposes.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling, silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer, which prevents blue light from reaching the underlying layers, is conventionally located between the green-sensitive and blue-sensitive layers, Possible options for different layer arrangements and the effects thereof on photographic properties are described in *J. Inf. Rec. Mats.,* 1994, volume 22, pages 183–193 and in *Research Disclosure* 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in a photographic film in order to increase sensitivity (DE 25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part II A (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89 and in *Research Disclosure* 38957, part VA ( 1996), page 603 .

Photographic materials with camera sensitivity conventionally contain silver bromide-iodide emulsions, which may optionally also contain small proportions of silver chloride. Photographic print materials contain either silver chloride-bromide emulsions with up to 80 mol.% of AgBr or silver chloride-bromide emulsions with above 95 mol.% of AgCl.

Details relating to colour couplers may be found in *Research Disclosure* 37254, part 4 (1995), page 288, in *Research Disclosure* 37038, part II (1995), page 80 and in *Research Disclosure* 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290, in *Research Disclosure* 37038, part XIV (1995), page 86 and in *Research Disclosure* 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 mm in diameter).

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part XD (1996), pages 621 et seq..

The photographic material may also contain optical brighteners, spacers, filter dyes, formalin scavengers, light stabilisers, anti-oxidants, $D_{min}$ dyes, additives to improve the stability of dyes, couplers and whites and to reduce colour fogging, plasticisers (lattices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX, X (1996), pages 607 and 610 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part IIB (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX, XX (1996), pages 630 et seq. together with example materials.

EXAMPLE 1

Layer Structure 1

A colour photographic recording material was produced by applying the following layers in the stated sequence onto a film base of paper coated on both sides with polyethylene. Quantities are all stated per 1 $m^2$. The silver halide application rate is stated as the corresponding quantities of $AgNO_3$.

| | | |
|---|---|---|
| Layer 1: | (Substrate layer) | |
| | 0.10 g | of gelatine |
| Layer 2: | (Blue-sensitive layer) | |
| | Blue-sensitised silver halide emulsion (99.5 mol % chloride, 0.5 mol. % bromide, average grain diameter 0.9 mm) prepared from 0.50 g of $AgNO_3$ with | |
| | 0.70 mg | of blue sensitiser BS-1 |
| | 0.30 mg | of stabiliser ST-1 |
| | 1.25 g | of gelatine |
| | 0.55 g | of yellow coupler Y-1 |
| | 0.10 g | of image stabiliser BST-1 |
| | 0.50 g | of oil former OF-1 |
| Layer 3: | (Interlayer) | |
| | 1.10 g | of gelatine |
| | 0.60 g | of DOP scavenger EF-1 |
| | 0.06 g | of DOP scavenger EF-2 |
| | 0.12 g | of tricresyl phosphate (TCP) |
| Layer 4: | (Green-sensitive layer) | |
| | Green-sensitised silver halide emulsion (99.5 mol. % chloride, 0.5 mol. % bromide, average grain diameter 0.47 mm) prepared from 0.40 g of $AgNO_3$ with | |
| | 0.70 mg | of green sensitiser GS-1 |
| | 0.50 mg | of stabiliser ST-2 |
| | 0.77 g | of gelatine |
| | 0.41 g | of magenta coupler M-1 |

-continued

| | | |
|---|---|---|
| | 0.06 g | of image stabiliser BST-2 |
| | 0.12 g | of DOP scavenger EF-2 |
| | 0.34 g | of dibutyl phthalate (DBP) |
| Layer 5: | (UV protective layer) | |
| | 0.95 g | of gelatine |
| | 0.50 g | of UV absorber UV-1 |
| | 0.03 g | of DOP scavenger EF-1 |
| | 0.03 g | of DOP scavenger EF-2 |
| | 0.15 g | of oil former OF-2 |
| | 0.15 g | of TCP |
| Layer 6: | (Red-sensitive layer) | |
| | Red-sensitised silver halide emulsion (99.5 mol. % chloride, 0.5 mol. % bromide, average grain diameter 0.5 mm) prepared from 0.30 g of $AgNO_3$ with | |
| | 0.03 mg | of red sensitiser RS-1 |
| | 0.60 mg | of stabiliser ST-3 |
| | 1.00 g | of gelatine |

-continued

| | | |
|---|---|---|
| | 0.46 g | of cyan coupler C-1 |
| | 0.46 g | of TCP |
| Layer 7: | (UV protective layer) | |
| | 0.30 g | of gelatine |
| | 0.20 g | of UV absorber UV-1 |
| | 0.10 g | of oil former OF-3 |
| Layer 8: | (Protective layer) | |
| | 0.90 g | of gelatine |
| | 0.05 g | of optical brightener WT-1 |
| | 0.07 g | of mordant (polyvinylpyrrolidone) |
| | 1.20 mg | of silicone oil |
| | 2.50 mg | of spacers (polymethyl methacrylate, average particle size 0.8 mm) |
| | 0.30 g | of hardener H-1 |

Compounds used in layer structure 1:

BS-1

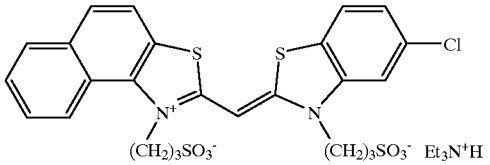

GS-1

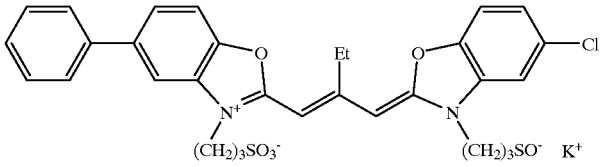

RS-1

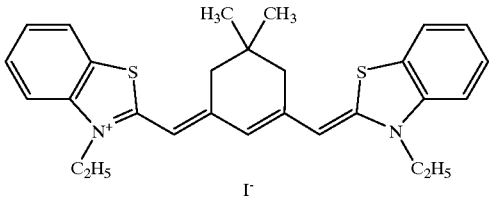

ST-1

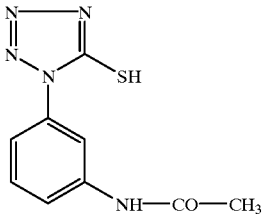

ST-2

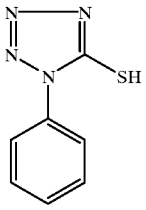

-continued
ST-3
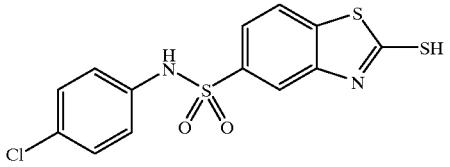
Y-1
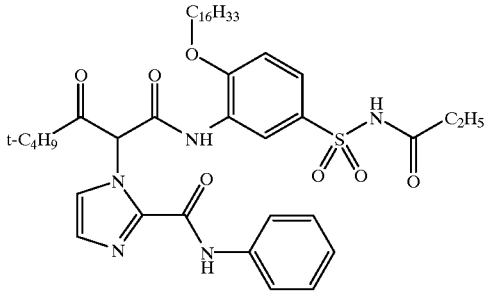
M-1
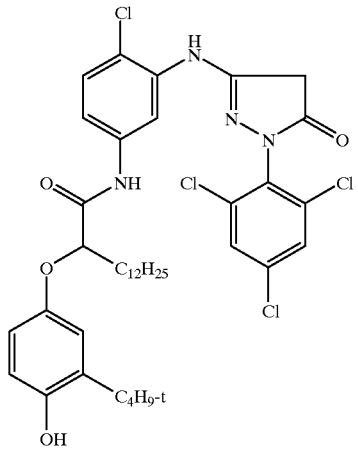
C-1
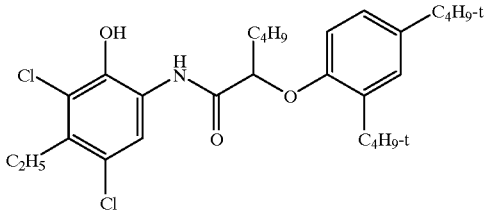
BST-1
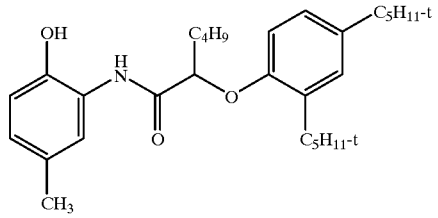

-continued
BST-2
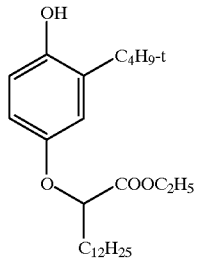
EF-1
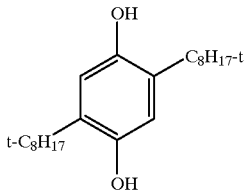
EF-2
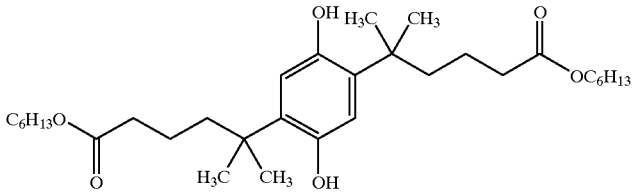
OF-1 Polyester prepared from $HOOC—(CH_2)_4—COOH$, $HO—CH_2—C(CH_3)_2—CH_2—OH$ and $C_{10}H_{21}$-i
$\eta$(20° C.): 4000–5000 mPa · s
$n_D$(20° C.): 1.464–1.467
OF-2
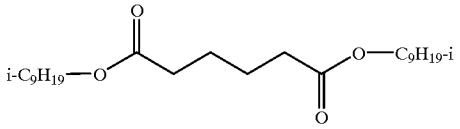
OF-3
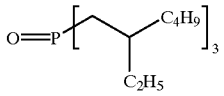
UV-1
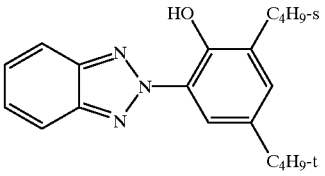
and
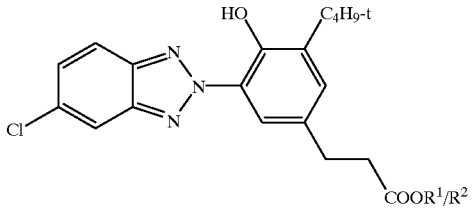
$R^1$ = —$C_8H_{17}$
$R^2$ = —$CH_2$—CH($C_2H_5$)—$C_4H_9$
$R^1/R^2$ = 1:1
in a ratio by weight of 90:10

-continued

WT-1

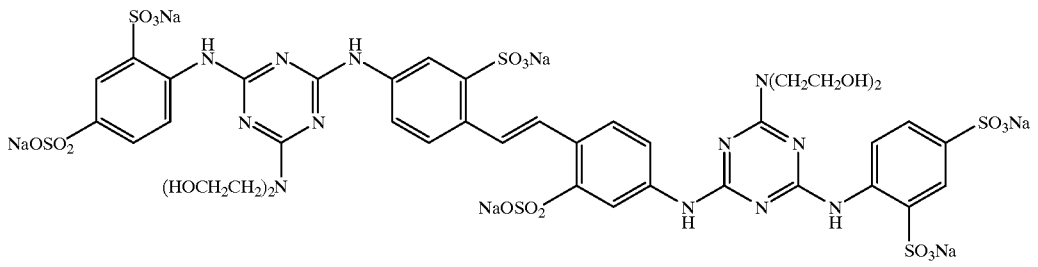

H-1

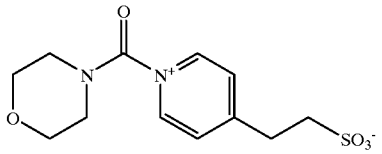

Layer Structures 2 and 3

Layer structures 2 and 3 are the same as layer structure 1 with regard to structure and composition and differ only in that the UV absorber UV-1 in layers 5 and 7 is replaced by an identical quantity of the substances stated in table 1. Oil formers OF-2 and OF-3 respectively were also omitted from these layers.

The samples were exposed through a step wedge, wherein colour filters were placed in the beam path such that a neutral grey is obtained at D=0.7. The material was then processed as follows:

| | |
|---|---|
| a) Colour developer - 45 s - 35° C. | |
| Tetraethylene glycol | 20.0 g |
| N,N-diethylhydroxylamine | 4.0 g |
| N-ethyl-N-(2-methanesulfonamidoethyl)-4-amino-3-methyl-benzene sulfate | 5.0 g |
| Potassium sulfite | 0.2 g |
| Potassium carbonate | 30.0 g |
| Hydroxyethanediphosphonic acid | 0.2 g |
| Polymaleic anhydride | 2.5 g |
| Optical brightener (4,4'-diaminostilbenesulfonic acid derivative) | 2.0 g |
| Potassium bromide | 0.02 g |
| make up to 1000 ml with water; adjust pH value to pH 10.2 with KOH or $H_2SO_4$. | |
| b) Bleach/fixing bath - 45 s - 35° C. | |
| Ammonium thiosulfate | 75.0 g |
| Sodium hydrogen sulfite | 13.5 g |

-continued

| | |
|---|---|
| Ethylenediaminetetraacetic acid (iron/ammonium salt) | 45.0 g |
| make up to 1000 ml with water; adjust pH value to pH 6.0 with ammonia (25 wt. %) or acetic acid. | |
| c) Rinsing - 90 s - 33° C. | |
| d) Drying | |

The samples are then exposed to the light from a daylight-standardised xenon lamp and the change in colour density and yellow fog determined (c.f. table 1).

The UV absorbers used in layers 5 and 7 were:

UV-2 40 wt. % dispersion of ZnO in octyldodecyl neopentanoate, average particle diameter 90 nm (quantity used relative to ZnO)

UV-3 30 wt. % aqueous dispersion of monocrystalline Si particles, average particle diameter 30 nm (quantity used relative to Si)

As table 1 shows, UV absorber UV-3 according to the invention is superior to the comparison compound UV-1 by virtue of its intrinsic light stability after extended periods of irradiation. The UV absorber according to the invention is superior to comparison compound UV-2 by virtue of its higher UV absorption in the long-wave UV range even after short periods of irradiation.

TABLE 1

| Layer structure | UV absorber | Intensity of irradiation [$10^6 \cdot$ Lxh] | Δ yellow fog (%) | Δ colour density (%) | | | | | |
|---|---|---|---|---|---|---|---|---|---|
| | | | | $D_{yellow}$ = 0.3 | $D_{yellow}$ = 1.0 | $D_{magenta}$ = 0.3 | $D_{magenta}$ = 1.0 | $D_{cyan}$ = 0.3 | $D_{cyan}$ = 1.0 |
| 1 (C) | UV-1 | 15 | +20 | −41 | −20 | −48 | −26 | −43 | −20 |
| | | 30 | +38 | −78 | −43 | −82 | −58 | −79 | −45 |
| 2 (C) | UV-2 | 15 | +26 | −50 | −27 | −60 | −33 | −52 | −28 |
| | | 30 | +39 | −81 | −46 | −83 | −60 | −81 | −48 |
| 3 (I) | UV-3 | 15 | +18 | −40 | −20 | −45 | −25 | −40 | −19 |
| | | 30 | +32 | −71 | −36 | −77 | −48 | −71 | −36 |

(C: Comparison,
I: invention)

EXAMPLE 2

Layer Structure 4

A colour photographic recording material was produced by applying the following layers in the stated sequence onto a film base of paper coated on both sides with polyethylene. Quantities are all stated per 1 $m^2$. The silver halide application rate is stated as the corresponding quantities of $AgNO_3$.

| | |
|---|---|
| Layer 1: (Substrate layer) | |
| 0.10 g | of gelatine |
| Layer 2: (Blue-sensitive layer) | |
| Blue-sensitised silver halide emulsion (99.5 mol. % chloride, 0.5 mol. % bromide, average grain diameter 0.9 mm) prepared from 0.45 g of $AgNO_3$ with | |
| 0.70 mg | of blue sensitiser BS-1 |
| 0.30 mg | of stabiliser ST-1 |
| 1.25 g | of gelatine |
| 0.55 g | of yellow coupler Y-2 |
| 0.10 g | of image stabiliser BST-3 |
| 0.50 g | of oil former OF-1 |
| Layer 3: (Interlayer) | |
| 1.10 g | of gelatine |
| 0.06 g | of DOP scavenger EF-3 |
| 0.01 g | of DOP scavenger EF-4 |
| 0.12 g | of tricresyl phosphate (TCP) |
| Layer 4: (Green-sensitive layer) | |
| Green-sensitised silver halide emulsion (99.5 mol. % chloride, 0.5 mol. % bromide, average grain diameter 0.47 mm) prepared from 0.26 g of $AgNO_3$ with | |
| 0.45 mg | of green sensitiser GS-1 |
| 0.30 mg | of stabiliser ST-2 |
| 0.77 g | of gelatine |
| 0.22 g | of magenta coupler M-2 |
| 0.18 g | of image stabiliser BST-4 |
| 0.12 g | of image stabiliser BST-5 |
| 0.22 g | of isotetradecanol |
| 0.24 g | of TCP |
| Layer 5: (UV protective layer) | |
| 0.95 g | of gelatine |
| 0.50 g | of UV absorber UV-1 |
| 0.06 g | of DOP scavenger EF-3 |
| 0.01 g | of DOP scavenger EF-4 |
| 0.15 g | of oil former OF-2 |
| 0.15 g | of TCP |
| Layer 6: (Red-sensitive layer) | |
| Red-sensitised silver halide emulsion (99.5 mol. % chloride, 0.5 mol. % bromide, average grain diameter 0.5 mm) prepared from 0.30 g of $AgNO_3$ with | |
| 0.03 mg | of red sensitiser RS-1 |
| 0.60 mg | of stabiliser ST-3 |
| 1.00 g | of gelatine |
| 0.46 g | of cyan coupler C-1 |
| 0.46 g | of TCP |
| Layer 7 (UV protective layer) | |
| 0.30 g | of gelatine |
| 0.20 g | of UV absorber UV-1 |
| 0.10 g | of oil former OF-3 |
| Layer 8 (Protective layer) | |
| 0.90 g | of gelatine |
| 0.05 g | of optical brightener WT-1 |
| 0.07 g | of mordant |

-continued

| | |
|---|---|
| | (polyvinylpyrrolidone) |
| 1.20 mg | of silicone oil |
| 2.50 mg | of spacers (polymethyl methacrylate, average particle size 0.8 mm) |
| 0.30 g | of hardener H-1 |

Compounds used in layer structure 4:

Y-2

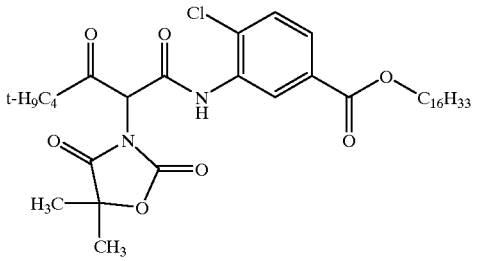

M-2

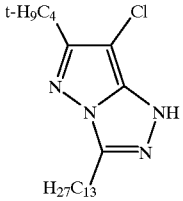

BST-3

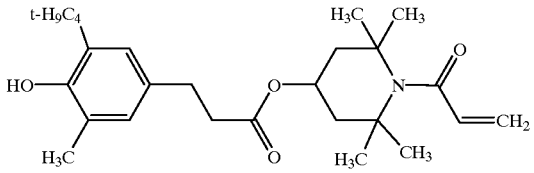

BST-4

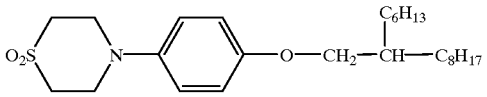

BST-5

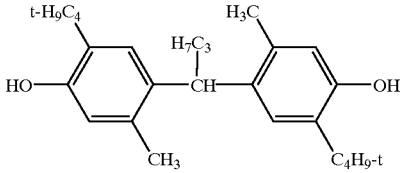

-continued

EF-3

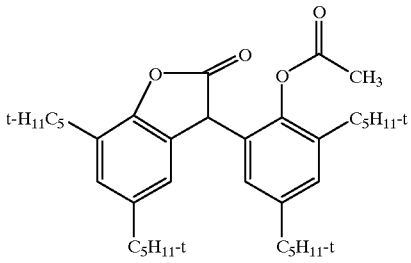

EF-4

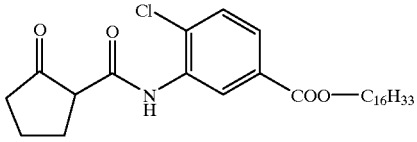

Layer Structures 5, 6 and 7

Layer structure 5 is the same as layer structure 4 with regard to structure and composition and differ only in that the UV absorber UV-1 in layers 5 and 7 is replaced by an identical quantity of the substances stated in table 2. Oil formers OF-2 and OF-3 respectively were also omitted from these layers.

Layer structure 6 is the same as layer structure 4 with regard to structure and composition and differs only in that the yellow coupler Y-2 in layer 2, magenta coupler M-2 in layer 4 and cyan coupler C-1 in layer 6 are replaced by an identical quantity of Y-3, M-3 and C-2, respectively.

Layer structures 5 and 7 are the same as layer structures 4 and 6 respectively with regard to structure and composition and differ only in that the UV absorber UV-1 in layers 5 and 7 is replaced by an identical quantity of UV-4. Oil formers OF-2 and OF-3 respectively were also omitted from these layers.

The samples were exposed through a step wedge, wherein colour filters were placed in the beam path such that a neutral grey is obtained at D=0.7. The material was then processed and tested as the materials of layer structures 1 to 3 (c.f. table 2).

UV-4 30 wt. % aqueous dispersion of monocrystalline Si particles, average particle diameter 20 nm (quantity used relative to Si)

Y-3

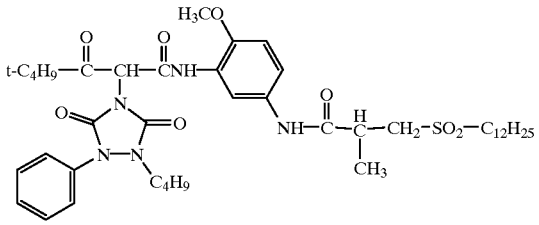

M-3

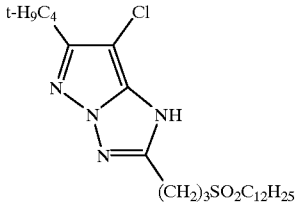

6:4 mixture of C-1 and

C-2

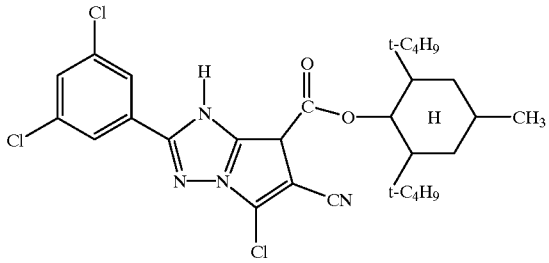

As table 2 shows, UV absorber UV-4 according to the invention is superior to the comparison compound UV-1 by virtue of its intrinsic light stability after extended periods of irradiation.

TABLE 2

| Layer structure | UV absorber | Intensity of irradiation [$10^6 \cdot$ Lxh] | Δ yellow fog (%) | Δ colour density (%) $D_{yellow}$ = 0.3 | $D_{yellow}$ = 1.0 | $D_{magenta}$ = 0.3 | $D_{magenta}$ = 1.0 | $D_{cyan}$ = 0.3 | $D_{cyan}$ = 1.0 |
|---|---|---|---|---|---|---|---|---|---|
| 4 (C) | UV-1 | 15 | +15 | −32 | −18 | −47 | −26 | −43 | −20 |
| | | 30 | +30 | −68 | −34 | −78 | −56 | −79 | −45 |
| 5 (I) | UV-4 | 15 | +12 | −32 | −18 | −47 | −25 | −41 | −19 |
| | | 30 | +23 | −61 | −28 | −69 | −48 | −71 | −35 |
| 6 (C) | UV-1 | 15 | +14 | −47 | −25 | −21 | −13 | −52 | −28 |
| | | 30 | +27 | −80 | −49 | −39 | −25 | −90 | −63 |
| 7 (I) | UV-4 | 15 | +12 | −47 | −24 | −21 | −14 | −50 | −27 |
| | | 30 | +21 | −70 | −41 | −33 | −20 | −72 | −54 |

(C: Comparison,
I: invention)

We claim:

1. A color photographic recording material which comprises at least one photosensitive silver halide emulsion layer and optionally a non-photosensitive layer, which is arranged closer to the light source than the photosensitive silver halide emulsion layer, and at least one of the stated layers contains particles of elemental silicon and/or of solid compounds, in which silicon is present in stoichiometric excess, having an average diameter of ≦120 nm.

2. The color photographic recording material according to claim 1, wherein the solid compounds in which silicon is present in stoichiometric excess are compounds of the formula $Si_xZ_{1-x}$, where x>0.5 and Z is at least one element selected from the group consisting of C, N, O, Ge, Ca, Ba and Sr.

3. The color photographic recording material according to claim 1, wherein the solid compounds in which silicon is present in stoichiometric excess have a core/shell structure.

4. The color photographic recording material according to claim 1, wherein the particles are spherical.

5. The color photographic recording material according to claim 1, wherein the particles have a size distribution with a maximum half-width of 40 nm.

6. The color photographic recording material according to claim 1, wherein the particles are enclosed in an oxide layer having a thickness of 1 nm to 300 nm.

7. The color photographic recording material according to claim 1, wherein the particles are present in the recording material in a quantity of 0.1 to 2.5 $g/m^2$.

8. The color photographic recording material according to claim 1, wherein the color photographic recording material comprises a color photographic paper or a transparent color photographic film for display purposes.

9. The color photographic recording material according to claim 1, wherein said silicon has an average diameter between 1 nm and 70 nm.

10. The color photographic recording material according to claim 5, wherein said silicon has an average diameter between 10 nm and 50 nm.

11. The color photographic recording material according to claim 2, wherein Z is C or Ge and x is <0.7.

12. The color photographic recording material according to claim 3, wherein said core is titanium nitride and said shell is silicon wherein the proportion of silicon by volume in each particle is at least 30%.

13. The color photographic recording material according to claim 6, wherein the particles are enclosed in an oxide layer having a thickness of 10 nm to 100 nm.

* * * * *